United States Patent [19]

Johnston

[11] Patent Number: 4,498,533

[45] Date of Patent: Feb. 12, 1985

[54] KEYHOLE MANDREL WITH INSERT POCKET

[75] Inventor: Russell A. Johnston, Houston, Tex.

[73] Assignee: Camco, Incorporated, Houston, Tex.

[21] Appl. No.: 586,491

[22] Filed: Mar. 5, 1984

[51] Int. Cl.[3] ..... E21B 23/03

[52] U.S. Cl. ..... 166/117.5

[58] Field of Search ..... 166/117.5, 117.6, 381, 166/382

[56] References Cited

U.S. PATENT DOCUMENTS

| | | | |
|---|---|---|---|
| 3,741,299 | 6/1973 | Terral | 166/117.5 |
| 3,994,339 | 11/1976 | Goode et al. | 166/117.5 |
| 4,106,563 | 8/1978 | Gatlin et al. | 166/117.5 |
| 4,197,909 | 4/1980 | Terral | 166/117.5 |
| 4,201,265 | 5/1980 | Thomason et al. | 166/117.5 |
| 4,271,902 | 6/1981 | Moore | 166/117.5 |
| 4,333,527 | 6/1982 | Higgins et al. | 166/117.5 |
| 4,416,330 | 11/1983 | Merritt et al. | 166/117.5 |

*Primary Examiner*—Stephen J. Novosad
*Assistant Examiner*—Michael Starinsky

[57] ABSTRACT

A sidepocket mandrel having a one piece body section with a keyhole cross section extending from one end of the body to the other end of the body forms an open bore and an offset bore. A one piece integral insert having a locking shoulder and a sidepocket includes an external shape to mate in the offset bore in the lower portion of the body allowing the upper portion of the offset bore to function as a discriminator.

5 Claims, 10 Drawing Figures

Fig. 1
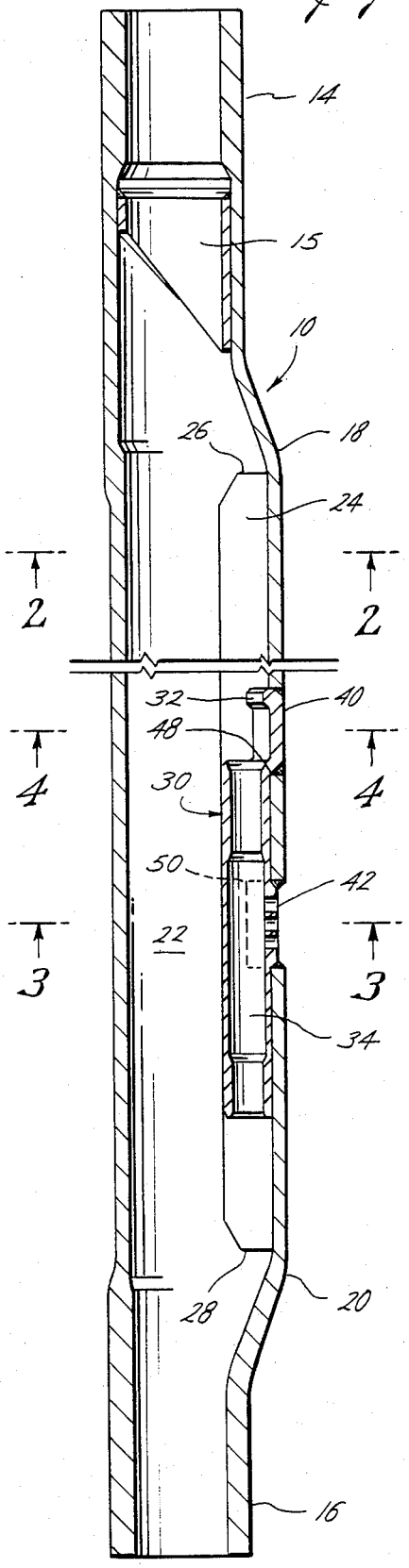
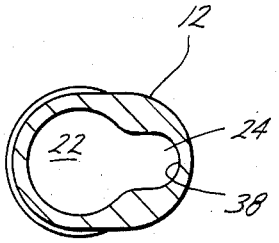
Fig. 2
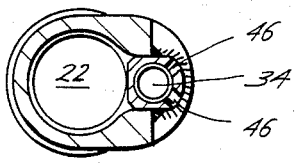
Fig. 3
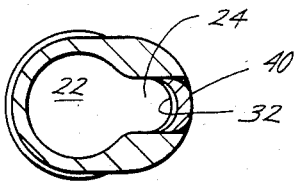
Fig. 4

KEYHOLE MANDREL WITH INSERT POCKET

BACKGROUND OF THE INVENTION

It is well known to use a sidepocket mandrel in a well tubing having an orienting sleeve for aligning a kick-over tool for installing and removing flow control devices from the sidepocket of the mandrel with a discriminator in the mandrel above the pocket as shown in U.S. Pat. No. 3,741,299.

However, as the sidepocket mandrels are required to be used at greater depths in the wells, under increasing pressure conditions, and under deleterious environmental conditions, various types of constructions have been utilized to minimize the number and types of welds used to increase the strength of the mandrel and overcome the well conditions. For example, see U.S. Pat. Nos. 4,106,563; 4,197,909; 4,333,527; and 4,416,330. Obviously, the strongest mandrel could be made by machining the entire mandrel out of a piece of stock thereby providing a mandrel without any welds whatsoever. However, the cost of manufacture of such a mandrel would be prohibitive.

The present invention is directed to an improved sidepocket mandrel which reduces the amount of welds required, and in particular reduces the amount of extended structural welds, but provides a mandrel which can be manufactured at a reasonable cost.

SUMMARY

The present invention is directed to a sidepocket mandrel for use in a well having a one piece body section with a keyhole cross section which extends from one end of the body to the other end of the body with the keyhole cross section shape forming an open bore and a smaller offset bore adjacent the open bore. A one piece integral insert having a locking shoulder and a sidepocket is preferably provided with an external shape to mate with the internal shape of the offset bore. The insert is welded to the body through one or more small openings to provide a minimum of welds. The insert is positioned in the offset bore in the lower portion of the body whereby the upper portion of the offset bore functions as a discriminator for allowing the entrance of flow control devices into the sidepocket but prevents the entrance of open bore tools in the offset bore. End members are connected to the body which are adapted to provide connections for connection in a well tubing.

Yet a further object is wherein the integral insert includes one or more laterally extending projections which extend through coacting openings in the main body in which only the projections need to be welded adjacent the openings to minimize the amount of welds. The projection or projections provide more material at the openings to withstand burst pressure, aid in properly aligning the insert in the body and reduce the possibility of warping of the insert during welding.

Still a further object of the present invention is wherein first and second laterally extending projections are provided and the first laterally extending projection is formed by a locking shoulder in the insert and a second laterally extending projection is formed with flow openings and the first and second projections are spaced from each other.

Still a further object of the present invention is wherein the body section is an extruded body.

Other and further objects, features and advantages will be apparent from the following description of a presently preferred embodiment of the invention given for the purpose of disclosure and taken in conjunction with the accompanying drawings.

BRIEF DESCRIPTION OF THE DRAWINGS

FIG. 1 is a fragmentary elevational view, in cross section, of a sidepocket mandrel of the present invention, FIG. 2 is a cross-sectional view taken along the line 2—2 of FIG. 1, FIG. 3 is a cross-sectional view taken along the line 3—3 of FIG. 1, FIG. 4 is a cross-sectional view taken along the line 4—4 of FIG. 1.

DESCRIPTION OF THE PREFERRED EMBODIMENT

Figure 5:
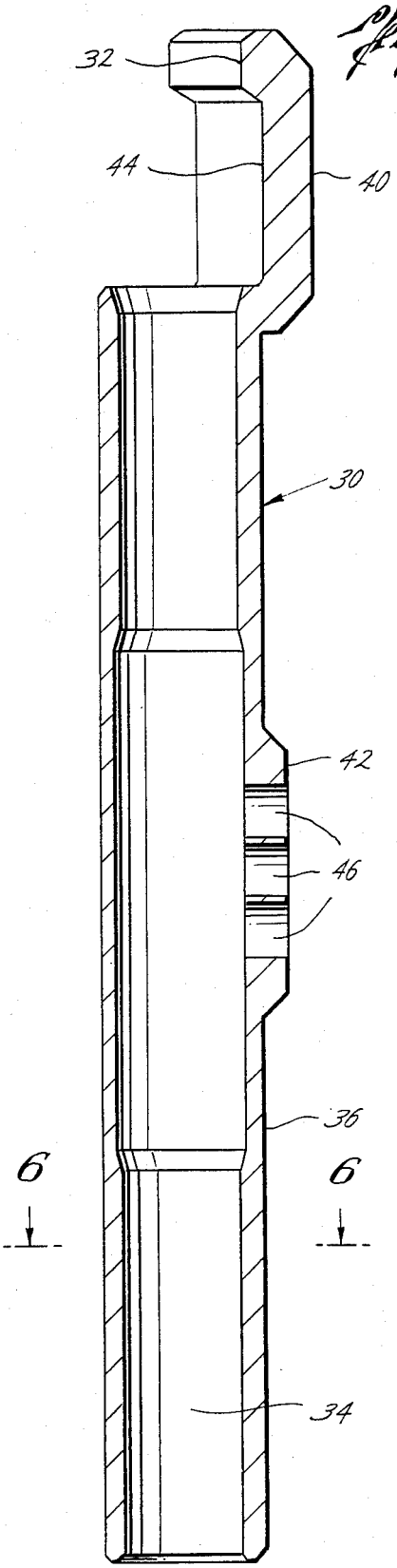
FIG. 5 is an enlarged elevational view, in cross section, of the integral insert having a locking shoulder and sidepocket of the present invention.

Referring now to the drawings, and particularly to FIG. 1, the reference numeral 10 generally indicates the improved keyhole mandrel of the present invention and generally includes a body section 12, an upper end section 14, and a lower end section 16.

The body section 12, as best seen in FIG. 2, has a keyhole cross section extending from the top end 18 of the body 12 to the bottom end 20 of the body section 12. While U.S. Pat. No. 4,416,330 discloses a keyhole shape in an upper body portion, the shape does not extend through the main body portion. The keyhole cross-sectional shape forms an open bore 22 extending therethrough for aligning with the bore in the ends 14 and 16. The keyhole cross-sectional shape also forms a smaller offset bore 24 adjacent the open bore. It is further noted that the body section 12 is a one piece body section and does not require a circumferential weld as U.S. Pat. No. 4,416,330. The entire mandrel 10 may be made out of an extruded keyhole cross section stock. In that event, the ends 14 and 16, as indicated, and orienting sleeve 15, may be formed as shown by any suitable method such as disclosed in patent application Ser. No. 584,048, filed Feb. 27, 1984 and entitled Integrally Formed Sidepocket Mandrel. Or as an alternative, only the one piece body section 12 need be extruded and the ends 14 and 16 may be separately swaged and connected by circumferential welds (not shown) at the ends 18 and 20 of the one piece body section 12.

In any event, whether the ends 14 and 16 are formed, such as forging or by machining the ends 26 and 28 of the offset bore 24 may be terminated and beveled as shown by any suitable method such as in the forging or machining process. The ends 14 and 16 are suitable and adapted to be suitably threaded for various types of threads for connection in a well tubing.

Figure 6:
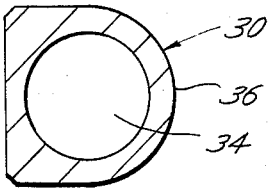
FIG. 6 is a cross-sectional view taken along the line 6—6 of FIG. 5.
Figure 7:
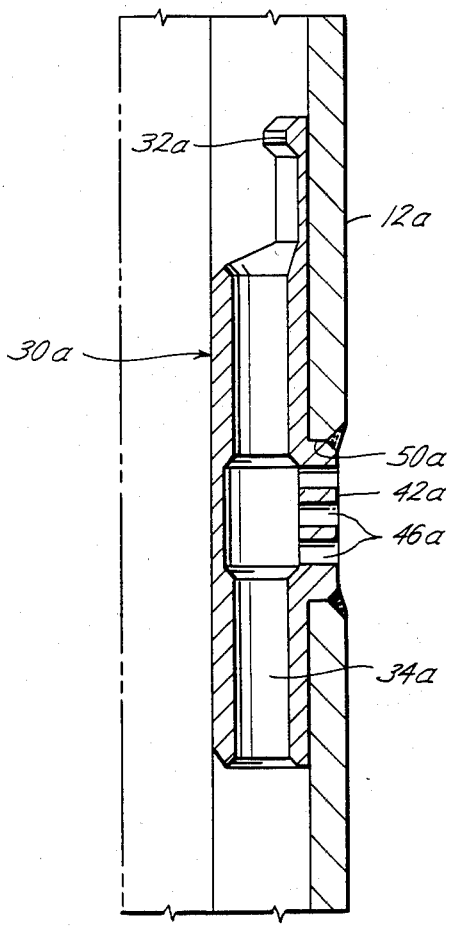
FIG. 7 is an enlarged elevational view in cross section of another form of an integral insert, welded to the mandrel.

Referring now to FIGS. 1, 3–6, a one piece integral insert generally indicated by the reference numeral 30 is provided which includes a locking shoulder 32 and a sidepocket 34 is provided. The sidepocket 34, as is conventional, is used to receive various types of flow control devices and the shoulder 32 is adapted to coact with any suitable well lock for securing a flow control device in the sidepocket 34. The insert, as best seen in FIGS. 5 and 6, preferably includes an external shaped surface 36 which is adapted to mate with the inside 38 (FIG. 2) of the offset bore 24 formed by the keyhole cross section. If desired, the insert 30 may include a first laterally extending projection 40 and a second laterally extending projection 42. The first projection is formed by the locking shoulder 32 and the lock recess 44. The second laterally extending projection 42 is formed with a plurality of fluid flow openings 46 for communicating fluid between the exterior of the mandrel 10 and the interior of the sidepocket 34.

The body section 12 includes one or more openings for welding the insert 30 to the body section 12. In the embodiment of FIGS. 1–6, there is provided a first opening 48 and a second opening 50 are provided for receiving the first and second projections 40 and 42, respectively. The first and second projections 40 and 42 are then welded to the main body section 12 around the openings 48 and 50 to provide a minimum number of linear inches of welding in the body 12. While the insert 30 can be welded in place through one or more openings with each having projections, the projections 40 and 42 are advantageous in providing more material in the cut out windows or openings 48 and 50 which act to withstand the burst forces present in the mandrel, act to correctly align the insert 30 in the body section 12, and act to prevent the tendency of the welds from warping the insert 30.

The insert 30 is positioned in the offset bore 24 in the lower portion of the body 12 whereby the upper portion of the offset bore 24 above the insert 30 functions as a discriminator for allowing the entrance of flow control devices but prevents the entrance of open bore tools in the offset bore.

Other types of inserts have been used in the past such as in U.S. Pat. No. 3,741,299 in which the insert consists of two parts, a discriminator or deflective guide, and a lock and sidepocket. However, in the device the two inserts were of considerable length as compared to the present insert 30 and required extensive longitudinal and transverse welds. In U.S. Pat. Nos. 4,106,563 and 4,197,909, the insert of a pocket was welded in the inside to a single window, but the rails providing the discriminator were welded to the inside and to the insert and had the disadvantage of possibly becoming misaligned while attempting to be secured therein and were difficult to secure in the interior of the body without leaving gaps or openings on which well tools and wire lines would catch. The present insert is advantageous in that it is shorter in that it only requires a shoulder and a pocket. The insert 30 does not require a discriminator as the offset bore 24 forms the discriminator. The two projections 40 and 42 provide a more secure attachment of the insert to the interior of the body by being spaced from each other. The insert, by being forged or cast, can be accurately manufactured to provide an excellent prefit and since the insert is entirely enclosed within the offset bore, it prevents the likelihood of creating cracks or openings which can catch on other tools.

Figure 10:
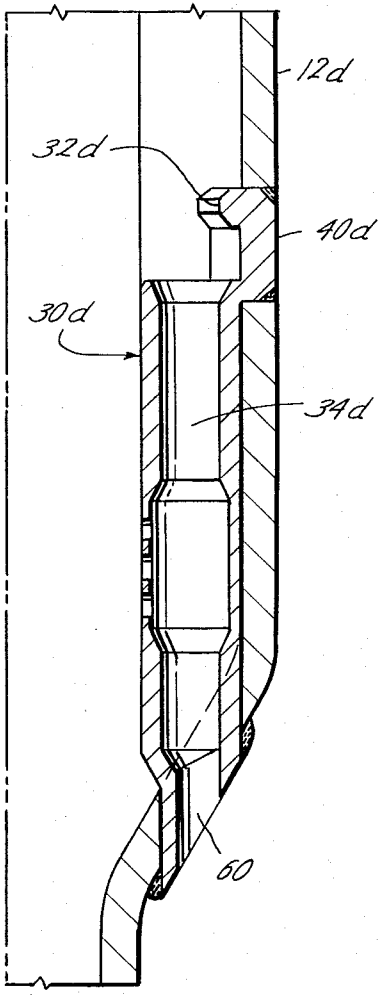
FIG. 10 is an enlarged elevational view in cross section of another form of an integral insert, welded to the mandrel.
Figure 9:
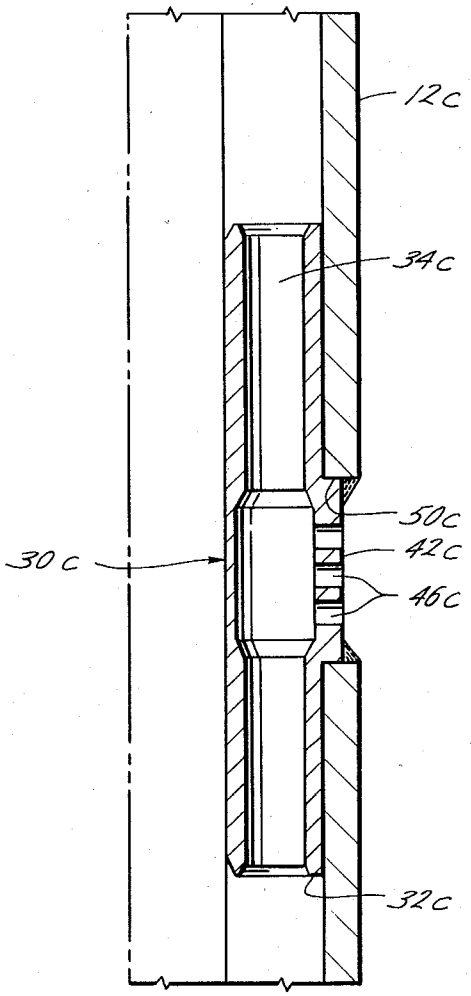
FIG. 9 is an enlarged elevational view in cross section of another form of an integral insert, welded to the mandrel.
Figure 8:
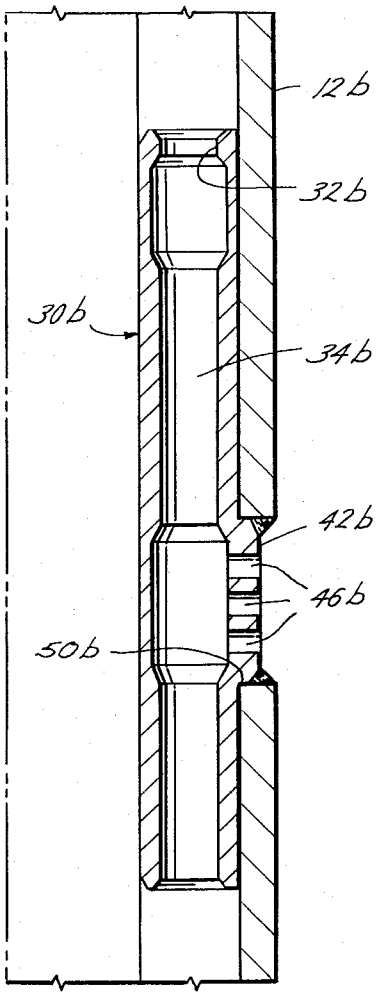
FIG. 8 is an enlarged elevational view in cross section of another form of an integral insert, welded to the mandrel.

Other and further embodiments of the insert 30 may be provided, as best seen in FIGS. 7–10, in which like parts to those in FIGS. 1–6 are similarly numbered with the addition of suffixes "a", "b", "c" and "d". Thus in FIG. 7 a single projection **42*a* is provided which projects into window 50*a* thereby further minimizing the extent of the weld required to secure the insert 30*a* in the body section 12*a*. In FIG. 8, the insert 30*a* is similar to the insert 30*a* with the exception that the latch shoulder 32*b* is designed to mate with a collect type latch or a type R sold by Camco, Incorporated. FIG. 9 is similar to FIGS. 7 and 8 except that the latch shoulder 32*a* is designed to work with a bottom latch such as a BK-1 type sold by Camco, Incorporated. In FIG. 10, the single lateral projection is 40*d* is formed by the shoulder 32*d*, and the sidepocket 42*d* is in communication with the outside of the mandrel by opening 60**.

In use, flow control devices may be conveniently installed and removed from the offset pocket 34 by a suitable kickover tool as more fully described in U.S. Pat. No. 3,741,299.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts, may be made which will readily suggest themselves to those skilled in the art and which are encompassed by the spirit of the invention and the scope of the appended claims.

What is claimed is:

1. A sidepocket mandrel for use in a well comprising, a one piece body section having a keyhole cross section extending from one end of the body to the other end of the body, said keyhole cross section shape forming an open bore extending therethrough for aligning with ends, and forming a smaller offset bore adjacent the open bore, a one piece integral insert having a locking shoulder and a sidepocket, said pocket adapted to receive flow control devices, and said shoulder adapted to coact with a well lock for securing said flow control devices in the sidepocket, said body including at least one opening extending into the offset bore for welding the insert to the body, said insert positioned in the offset bore in the lower portion of the body whereby the upper portion of the offset bore functions as a discriminator for allowing the entrance of flow control devices but preventing the entrance of open bore tools in the offset bore, and end members connected to said body, said members adapted to receive connections for connection in a well tubing.

2. A sidepocket mandrel for use in a well comprising, a one piece body section having a keyhole cross section extending from one end of the body to the other end of the body, said keyhole cross section shape forming an open bore extending therethrough for aligning the ends, and forming a smaller offset bore adjacent the open bore, a one piece integral insert having a locking shoulder and a sidepocket, said pocket adapted to receive flow control devices, and said shoulder adapted to coact with a well lock for securing said flow control devices in the sidepocket, said insert having an external shape to mate with the inside of the offset bore except for at least one laterally extending projection, said body including at least one opening extending into the offset bore for receiving said one projection, and said projection welded in said opening, said insert positioned in the offset bore in the lower portion of the body whereby the upper portion of the offset bore functions as a discriminator for allowing the entrance of flow control devices but preventing the entrance of open bore tools in the offset bore, and end members connected to said body, said members adapted to receive connections for connection in a well tubing.

3. A sidepocket mandrel for use in a well comprising, a one piece body section having a keyhole cross section extending from one end of the body to the other end of the body, said keyhole cross section shape forming an open bore extending therethrough for aligning with ends, and forming a smaller offset bore adjacent the open bore and extending therethrough, a one piece integral insert having a locking shoulder and a sidepocket, said pocket adapted to receive flow control devices, and said shoulder adapted to coact with a well lock for securing said flow control devices in the sidepocket, said insert having an external shape to mate with the inside of the offset bore formed by the keyhole cross section except for a first laterally extending projection formed by the locking shoulder, and a second laterally extending projection formed with flow openings, said body including first and second openings into said offset bore receiving said first and second projections, respectively, said insert positioned in the offset bore in the lower portion of the body whereby the upper portion of the offset bore functions as a discriminator for allowing the entrance of flow control devices but preventing the entrance of open bore tools in the offset bore, and end members connected to said body, said members adapted to receive connections for connection in a well tubing.

4. The apparatus of claim 3 wherein said body section is an extruded body.

5. The apparatus of claim 3 wherein said laterally extending projections are spaced apart from each other.

* * * * *